United States Patent [19]

Price et al.

[11] Patent Number: 5,012,618

[45] Date of Patent: May 7, 1991

[54] MAGNETIC DISC SURFACE TREATMENT AND APPARATUS

[75] Inventors: Rick C. Price, Fremont; Atef H. Eltoukhy, Saratoga; Yassin Mehmandoust, Berkeley, all of Calif.

[73] Assignee: HMT Technology Corporation, Fremont, Calif.

[21] Appl. No.: 454,284

[22] Filed: Dec. 21, 1989

[51] Int. Cl.[5] ..... B24B 21/00

[52] U.S. Cl. ..... 51/140; 51/141; 51/145 R

[58] Field of Search ..... 51/328, 281 SF, 140, 51/141, 135, 145 R, 150, 145 T, 146, 148, 149, 151, 152, 154, 155, 142, 143, 144, 165

[56] References Cited

U.S. PATENT DOCUMENTS

| | | | |
|---|---|---|---|
| 3,524,284 | 8/1970 | Meane | 51/135 R |
| 3,971,163 | 7/1976 | Thombley et al. | 51/145 R |
| 4,075,791 | 2/1978 | Koide et al. | 51/145 R |
| 4,535,567 | 8/1985 | Seaborn | 51/145 R |
| 4,656,790 | 4/1987 | Mukai et al. | 51/141 |
| 4,671,018 | 6/1987 | Ekhoff | 51/145 T |
| 4,796,387 | 1/1989 | Johnson | 51/141 |

*Primary Examiner*—Frederick R. Schmidt
*Assistant Examiner*—Blynn Shideler
*Attorney, Agent, or Firm*—Peter J. Dehlinger

[57] ABSTRACT

Method and apparatus for treating the surface of a magnetic disc to remove surface asperities and loosely bound material. The disc is alternatively treated by contact with a pair of moving belt-like tapes, a pair of flying heads, and second contact with the belt-like tape, with the disc carried at a fixed position for rotation in a vertical plane throughout, but rotated at a higher speed during the intermediate flying waffling step. The first and/or second tape-treatment steps can be used to apply a lubricant film to the disc surface.

3 Claims, 5 Drawing Sheets

MAGNETIC DISC SURFACE TREATMENT AND APPARATUS

FIELD OF THE INVENTION

The present invention relates to an automated method and apparatus for the surface treatment of a magnetic disc.

BACKGROUND OF THE INVENTION

Thin-film magnetic discs or media are widely used as data storage media for digital computers. The discs are typically formed by successively sputtering onto a rigid disc substrate, an underlayer, a magnetic layer, and a carbon overcoat which protects the magnetic layer against wear and reduces frictional forces between the disc and a read/write head.

A disc formed by the sputtering method just described typically contains uneven surface regions, due to surface irregularities in the substrate These irregularities, or asperities, may project above the surface of the disc several microinches. If the asperities were to make contact with a read/write head flying a few microinches over the surface of a spinning disc, the head could be ruined and/or the disc could crash. Therefore, it is necessary to subject the disc to a final surface treatment which removes surface asperities. It is also common to lubricate the disc, in a final surface treatment, with a thin film of a flurocarbon lubricant, to reduce frictional interactions between the head and the disc Heretofore, surface treatment of a magnetic medium to remove surface irregularities and debris on a magnetic disc has involved a two-step process which employs separate surface-treatment apparatuses In the first step, referred to herein as "buffing," or "tape-burnishing", the disc is positioned for rotation about a horizontal axis in a burnishing apparatus. This apparatus provides two pairs of movable, belt-like tapes which are brought into contact with the rotating disc, to remove surface debris and other loosely bound material by light abrasion The tapes may contain a lubricant for simultaneously applying lubricant to the surface.

In the second step, referred to herein as "waffle-burnishing," the disc is positioned for rotation about a vertical axis in a waffle-burnishing apparatus having a pair of waffle heads which are designed to fly over opposite-side surfaces of the spinning disc at a distance of 1–2 microinches, to remove asperities which may be formed integrally with the layers forming the disc. After the waffle-burnishing treatment, the disc is removed from the apparatus and may be further tested for read/write characteristics before packaging.

It can be appreciated that the surface treatment just described is inefficient, in that a technician must mount each disc in the tape-burnishing apparatus, wait for the tape-burnishing procedure to be completed, remove the disc from the apparatus, mount the disc on the waffle-burnishing apparatus, wait for completion of the waffle-burnishing procedure, then remove the disc for final packaging Another limitation of the prior-art method is that the waffle-burnishing procedure often leaves dislodged debris on the disc surfaces, particularly since the disc is disposed horizontally during the waffling procedure.

SUMMARY OF THE INVENTION

It is therefore a general object of the invention to provide a surface treatment method and apparatus which largely overcome above-discussed problems associated with prior-art disc surface-treatment methods.

A more specific object is to provide a method in which a single apparatus can perform the steps of tape-burnishing, waffle-burnishing, and lubricating a magnetic disc in an automated, programmed sequence.

In one aspect, the invention includes an apparatus for automated surface treatment of a magnetic disc having known inner and outer diameter dimensions. The apparatus includes a drive mechanism for rotating the disc about a fixed, horizontal axis at a selected disc rotation speed, a tape assembly having a pair of movable, belt-like tapes for contacting the surface of the disc, and a head assembly having a pair of heads adapted to fly over the opposite-side surfaces of the disc, between inner-diameter and outer-diameter positions.

The tape assembly and head assembly are alternately positioned and activated to contact the disc, at different selected disc speeds. Also included in the apparatus is a programmable logic device for controlling the movement and activation of the tape and head assemblies, and the disc rotation speed, for carrying out the disc-treatment steps in an automated fashion.

In a preferred embodiment, the tape assembly is moved along a substantially horizontal path between retracted and operative positions, and the head assembly is moved in a substantially vertical path below the disc, between retracted and operative positions. The logic element preferably includes a sensing element for sensing the position of the tape assembly, as the assembly approaches an uppermost, inner-diameter position, to produce a braking motion as the head assembly is first positioned for flying head operation.

Also included in the invention is an automated method for surface treatment of a magnetic disc having known inner and outer diameter dimensions. The method includes (a) rotating the disc about a fixed horizontal axis, (b) contacting opposite-side surfaces of the disc with movable, belt-like tapes to remove loosely bound debris from the disc surface, with the disc rotating at one speed, (c) contacting the disc with a pair of flying heads to dislodge asperities on the disc surface, with the disc rotating at a higher selected speed about the same axis, and (d) contacting the disc a second time with the belt-like tapes, to remove loosely bound particles dislodged from the disc by the flying head.

In one embodiment, the method includes applying a lubricant film to the disc surface by including the lubricant on the endless-belt tape.

These and other objects and features of the present invention will become more apparent when the following detailed description of the invention is read in conjunction with the accompanying drawings.

DETAILED DESCRIPTION OF THE INVENTION

Figure 1:
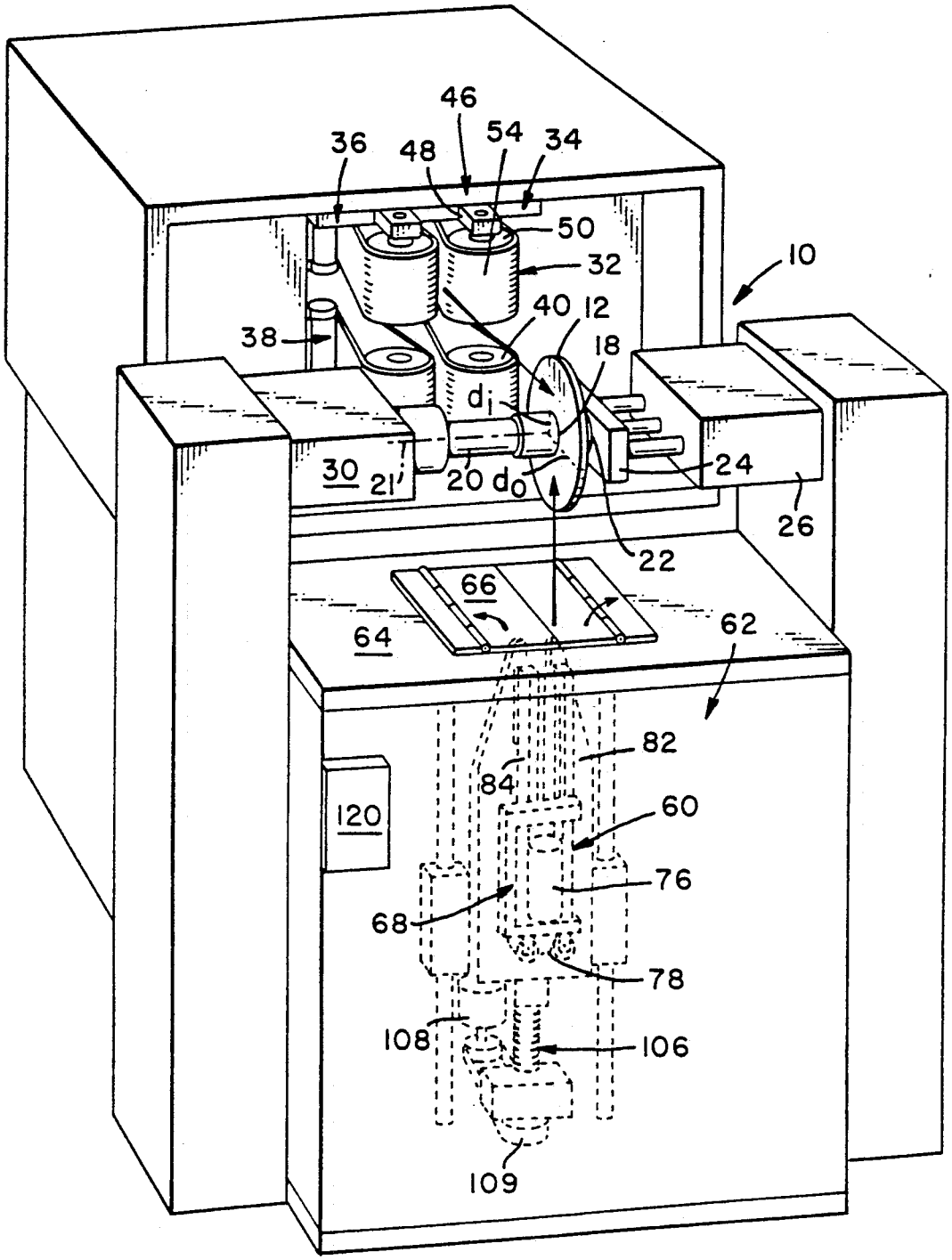
FIG. 1 is a perspective view of a surface-treatment apparatus constructed according to the invention.

FIG. 1 shows an automated apparatus 10 for the surface treatment of a magnetic disc according to the present invention. Disc 12 is a conventional hard disc magnetic medium having an outer diameter $d_0$, and an inner diameter $d_1$ which is defined by a central aperture 18 formed in the disc. Two conventional size discs have outer diameters of 130 or 95 mm, with corresponding inner diameters of 40 and 25 mm, respectively. Typically the disc is formed by sputtering an underlayer, magnetic layer, and carbon overcoat on a rigid substrate, and the resulting disc may contain asperities and loosely bound debris which are to be removed by the surface treatment.

The disc is mounted on a shaft 20 for rotation at a selective speed about a horizontal axis 21. The disc is clamped to the drive shaft by horizontal movement of a collar block 24 which is moved under the influence of a pneumatic system (shown at 26) toward and away from a position of disc locking. The shaft is driven for rotation by a motor, indicated at 30, whose speed can preferably be adjusted between about 0–2,000 rpm. The shaft, rotor, collar block and pseumatic system used to move the collar block are also referred to herein, collectively, as a drive mechanism for rotating the disc about a fixed horizontal axis, at a selected speed.

Figure 2:
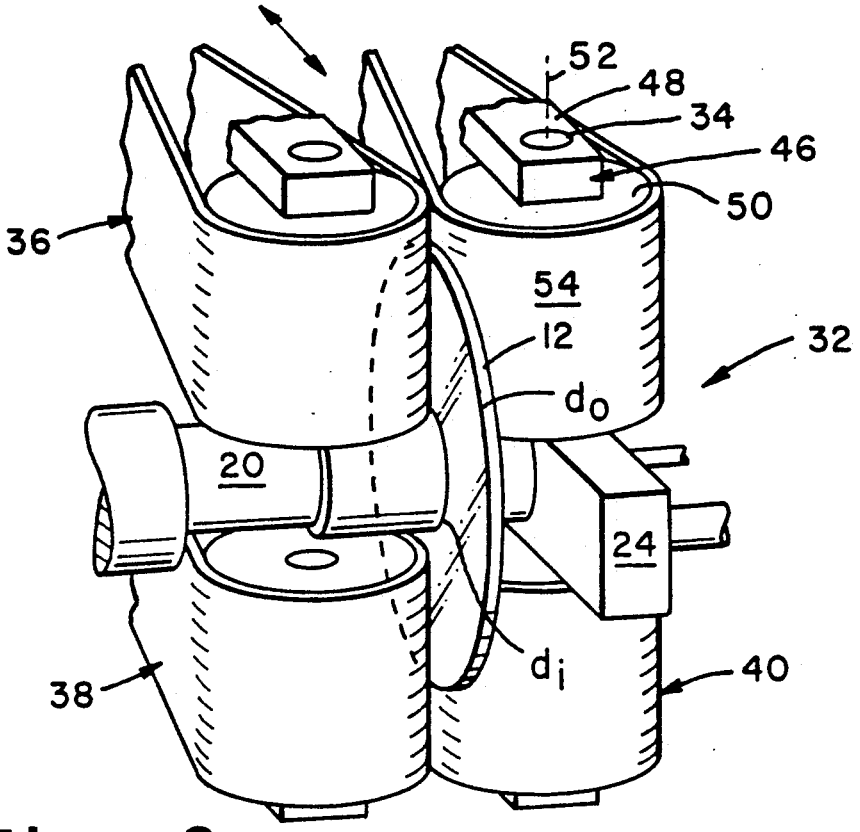
FIG. 2 is an enlarged perspective view of the tape assembly in the apparatus, shown in its operative position in contact with a disc.

To the rear of the drive assembly in the apparatus is a tape assembly, indicated generally at 32, and shown in FIG. 1 in a retracted position. The tape assembly includes four tape subassemblies 34, 36, 38, 40 for interacting with right and left, upper and lower portions of the disc surface, in the manner shown in FIG. 2. As seen in FIG. 2, subassemblies 34 and 36 provide a pair of movable belt-like tapes, such as tape 54 in subassembly 34, for contacting the opposite-side upper surface regions of the disc, and subassemblies 38 and 40 provide a second pair of movable, endless-belt tapes for contacting the opposite-side lower surface regions of the disc.

Figure 3:
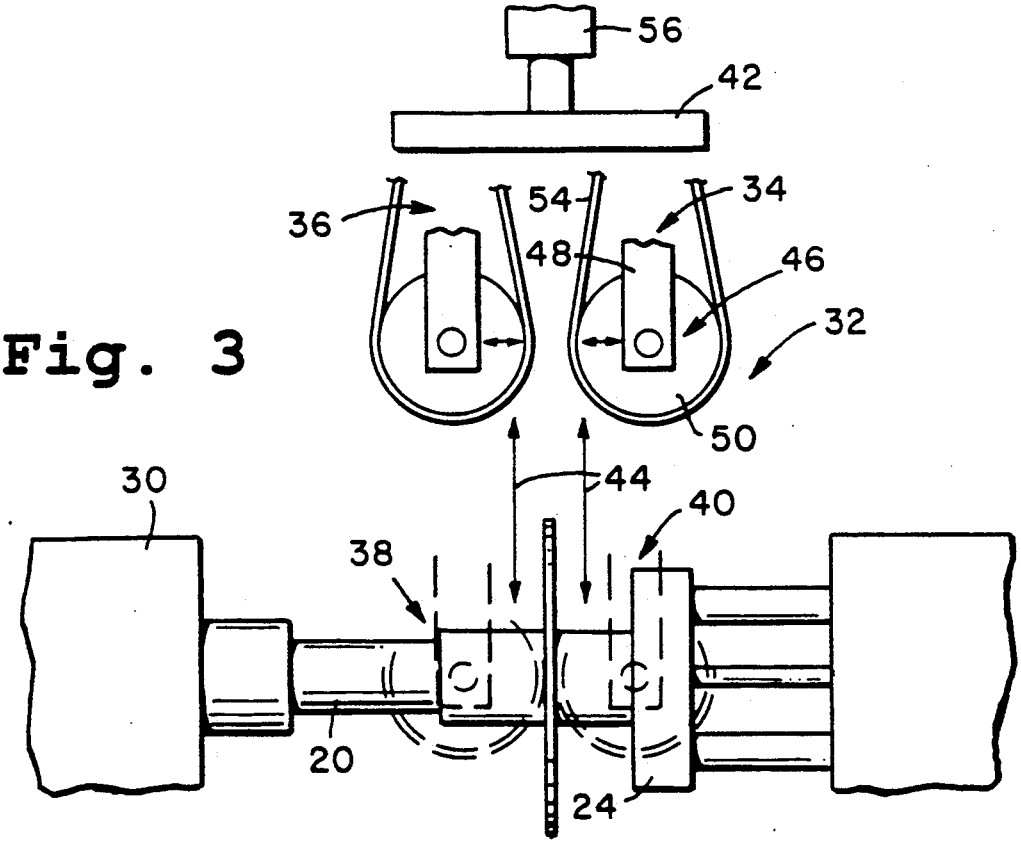
FIG. 3 is a plan view of the apparatus, showing the movement of the tape assembly in the apparatus between retracted and operative positions.

The four subassemblies are mounted on a movable support, shown schematically at 42 in FIG. 3, which is movable along a horizontal path in the direction of arrows 44 in the figure. The assembly is movable between a retracted position, shown in solid lines in FIG. 3, and an operative position, shown in dotted lines in FIG. 3, at which the tapes in the tape subassemblies are positioned to contact the disc surface, in a manner to be described.

Subassembly 34, which is representative, conventionally includes a roller device 46 which includes a pivot arm 48, and a roller 50 mounted on the arm for free rotation about a vertical axis 52. The arm is movable, under the influence of a pneumatically controlled device (not shown) in the subassembly toward away from a contact activated position at which the roller is biased against the confronting surface of a disc with a preselected pressure, typically about 1–8 psi at the disc surface. The upper and lower tape subassemblies may be operated independently to place the upper or lower pairs of tapes in contact with the disc, or may be operated as a unit to place both pairs of tapes in contact with the disc.

Tape 54 in the subassembly is advanced over the roller by conventional tape advance structure (not shown) in the subassembly, at a selected tape speed, typically about 35 cm/minutes. The direction of tape movement is opposite to that of disc rotation. The dimensions of the tape, and the height and positions of the fours rollers is such as to place the tape in each subassembly in contact with substantially the entire surface portion of the disc between the disc inner and outer diameters, as can be appreciated from FIG. 2. In one preferred embodiment, the tapes in the lower subassemblies are fibrous cloth tapes, such as polyester tapes, which are available commercially for use in a tape burnishing operation. One preferred type of tape is a polyester Durex 670 cloth tape available from Berkshire (Great Barrington, MA). In this embodiment, the tapes in the upper subassemblies are abrasive tapes, containing small-particle abrasive, typically 0.3–1 micron particles, such as supplied by 3M Company (Minneapolis, Minn).

The tape assembly, including the four tape subassemblies, is movable between its retracted and operative positions by a pneumatically controlled device connecting the frame of the apparatus to the support of the tape assembly. The device is indicated schematically at 56 in FIG. 3. The pneumatic device used to move the tape assembly, and the four pneumatically controlled devices used to position the four subassembly pivot arms at their positions of disc contact, are also referred to herein as moving means and actuating means, respectively.

With reference particularly to FIG. 3, the just described moving and activating means are operated such that the four subassembly rollers are moved away from their contact positions when the tape assembly is in its retracted position (solid lines in FIG. 3). To bring the four subassembly rollers into contact with the disc surfaces, the moving means advances the tape assembly to its operative position, and the activating means in the subassemblies are activated to move the four rollers to their contact positions against the disc surface, or alternatively, upper or lower subassemblies only may be activated for tape contact with the disc.

Also included in the tape assembly, but not shown here, are fluid-dispenser nozzles for infusing a tape in a subassembly a selected fluid One fluid which may be applied to the tapes is a freon-type cleaning fluid. Another fluid is a conventional perfluoropolyether lubricant. The fluid may be applied to the tape over a selected tape-travel period.

The elements of the apparatus just described, including the frame, drive mechanism and tape assembly are constructed conventionally and may be obtained commercially in a burnishing machine. One burnishing machine which is suitable for use in constructing the apparatus of the invention is an EDC Model 800, available from Exclusive Design Corp. (San Mateo, Calif.)

Figure 4:
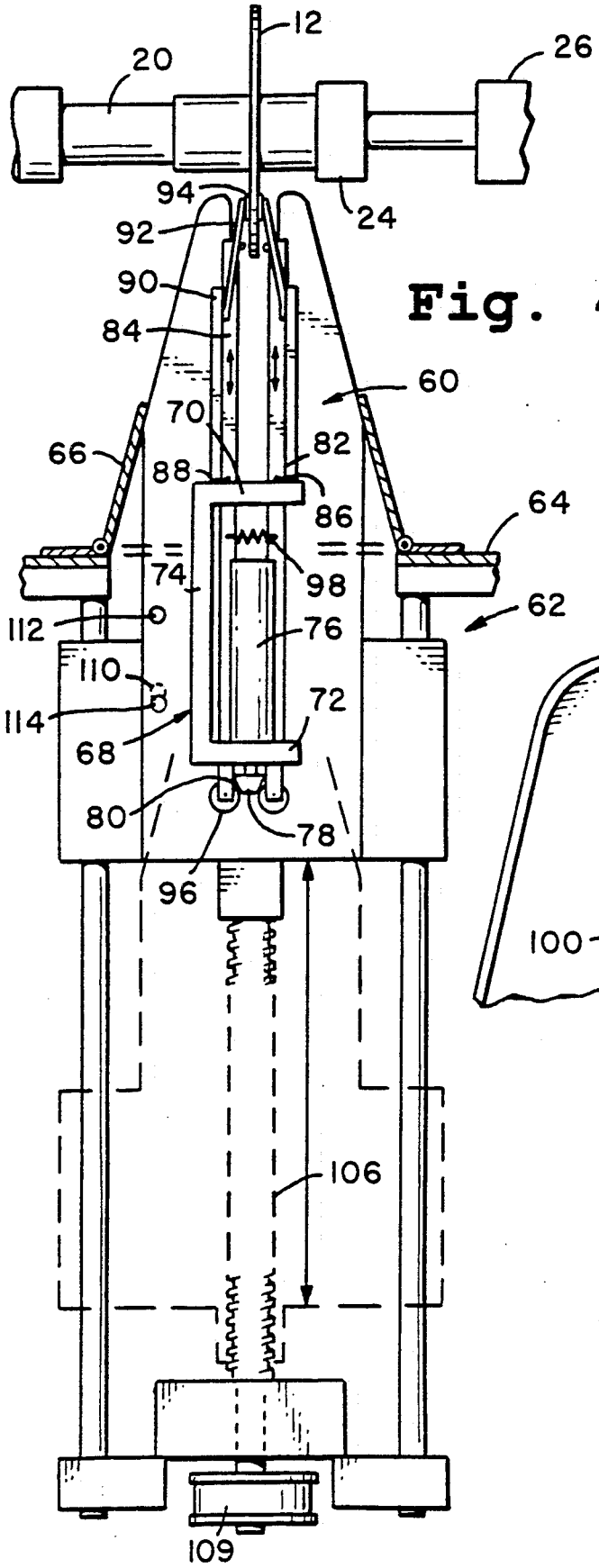
FIG. 4 is an enlarged front-on view of a head assembly in the apparatus, showing the heads in the assembly position for flying head contact with a disc.
Figure 5:
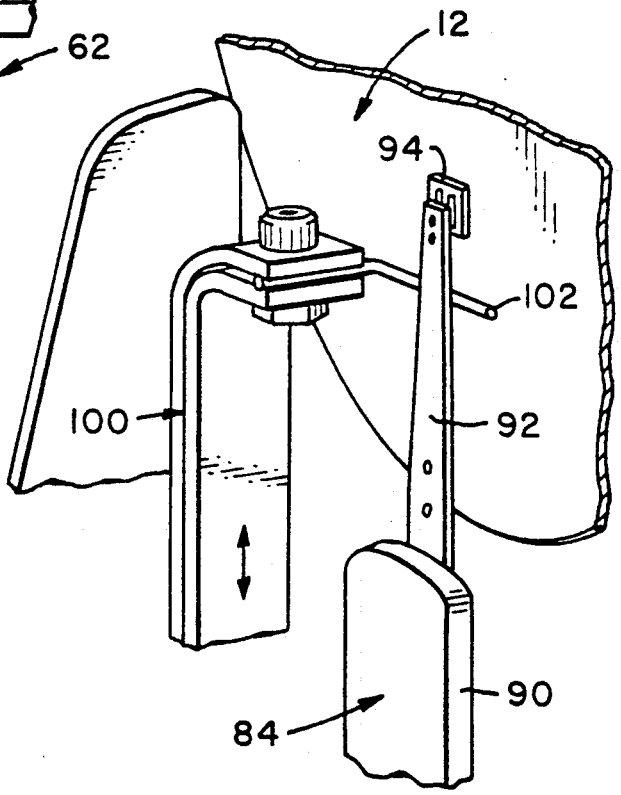
FIG. 5 is a detailed view of a waffle head in a position of contact with a disc.

With reference now particularly to FIGS. 1, 4, and 5, apparatus 10 further includes a head assembly indicated generally at 60. When not in operation, the head assembly is housed in a cabinet 62 forming part of the apparatus frame, and located below the disc drive mechanism. The upper surface of the cabinet, indicated at 64, is provided with a pair of swinging doors, such as door 66, which are spring biased toward a closed position, shown in FIG. 1, but which swing open, as the head assembly is moved upward out of the cabinet, as seen in FIG. 4.

The head assembly includes an C-shaped assembly frame 68 which is mounted on the frame of the apparatus for vertical movement, as will be described. As seen best in FIG. 3, frame 68 includes upper and lower frame elements 70, 72 respectively which extend from opposite ends of vertically disposed element 74. An pneumatic cylinder 76 mounted on the lower frame element carries a lower cam member 78 which is normally biased toward a raised position, and which is moved to a lowered position when the cylinder is actuated by supply of air pressure. The cam member has a pair of opposed cam surfaces, such as surface 80, which converge on progressing in a downward direction.

Pivotally mounted on the upper frame member are a pair of arms 82, 84, whose pivotal mountings on the upper frame member are shown at 86, 88, respectively. As seen best in FIG. 5, arm 84, which is representative, is composed of a relatively rigid section 90, and an upper spring-like extension 92 rigidly mounted on section 90. Rigidly attached to the upper end of the extension is a waffle head 94 which is designed conventionally to fly over the surface of the disc, when the disc is rotated at a selected speed, typically about 600 rpm, and the head is biased against the disc surface with a slight force, e.g., about 10 g.

Carried on the lower end of each arm is a roller, such as roller 96 on arm 84, which is positioned to contact and ride along the associated cam surface, such as surface 80, on cam member 78, as the cam member is moved from its raised to its lowered position. The two arm rollers are biased against the associated cam surfaces by a tension spring 98 which joins the two arms below their points of pivotal attachment to frame 62.

With the cam member in its raised position, the biasing of the two arms against the associated cam surfaces serves to position the waffle heads at the opposite ends of the two arms at spaced positions which allows a disc to be received therebetween, without contact between the head and disc. When the cam member is moved to its lower position, the lower ends of the arms are spread away from one another, causing the waffle heads to move toward one another, to positions of contact with the opposite surfaces of a disc placed therebetween. The cylinder, cam member, and arm rollers which interact with the cam member surfaces, are also referred to herein as activating means for moving the heads in the assembly toward and away from positions of contact with the disc surface.

With reference to FIG. 5, the force of each head against the confronting disc surface can be adjusted by an adjustable-position member, such as member 100. Each member provides a wire-like finger, such as finger 102, which is located to contact the spring-like extension of the associated arm in the head assembly, and whose spacing from the disc surface is adjustable to allow the associated waffle head to contact the disc surface with a selected force, when the head assembly is activated to move the heads toward a position of contact with the disc. The construction of the above head assembly, including the cam-activated movement of the heads between open and contact positions, and the adjustable-position members is conventional.

With reference particularly to FIGS. 1 and 4, the head assembly just described is mounted on the upper end of a worm drive 106 for vertical shifting between a retracted position, seen in FIG. 1, and an operative position, seen in FIG. 4. More specifically, the head assembly in the operative position is moved between an uppermost, inner-diameter position at which the two waffle heads are positioned to contact the opposite surfaces of the disc adjacent the disc's inner diameter, and a lowered, outer-diameter position at which the heads are positioned to contact the disc adjacent the disc's outer diameter. The head position shown in FIGS. 4 and 5 is intermediate these two extreme operative positions.

The vertical position of the head assembly on the worm drive is controlled by a stepper motor, shown schematically at 108 in FIG. 1, which is connected to the worm drive by a belt 109. The stepper motor, in turn, is controlled by pulses from a logic control device, to be described below. The gearing in the drive is such that the vertical position is moved at a pulse number of about 1 inch/1,000 pulses. The worm drive system, including the worm drive and stepper motor, is also referred to herein as means for moving the head assembly from its retracted position to its inner-diameter position, and between its inner- and outer-diameter positions.

With reference to FIG. 4, the inner-diameter position of the head assembly is controlled by a sensor 110 carried within cabinet 62 (FIG. 1). The sensor is triggered by magnetic elements 112, 114 mounted on the head assembly. Element 112 is positioned on the head assembly to interact with and trigger the sensor when the head assembly is adjacent, but somewhat below, its inner-diameter position. The second element 114 is positioned to interact with and trigger the sensor when the head assembly reaches its inner-diameter position.

The sensor and magnetic elements are also referred to herein collectively as sensor means for sensing the position of the head assembly at and adjacent its inner-diameter position. Although not shown here, the apparatus preferably includes two such sensor means—one for sensing an inner-diameter position of a 95 mm disc, and another for sensing an inner-diameter position of a 130-diameter disc.

Figure 6:
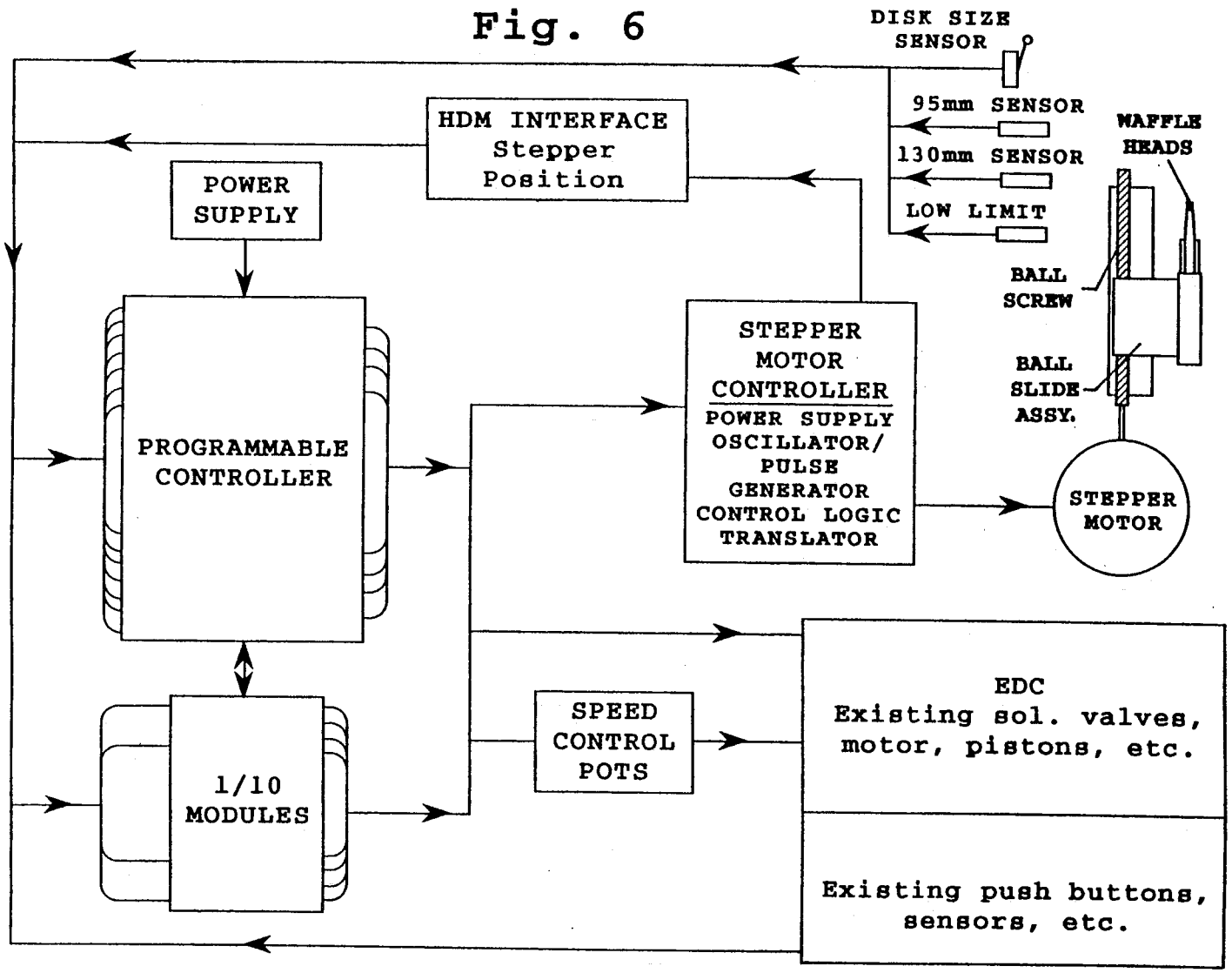
FIG. 6 is a block diagram showing the elements of the programmable logic device and its connections to other structure in the apparatus.

Also contained in the apparatus is a programmable logic device, shown schematically at 120 in FIG. 1, for controlling and directing the operation of the apparatus, as will now be considered. With particular reference to FIG. 6, the programmable device includes a programmable controller 122, which is programmed for a selected sequence of tape burnishing and waffling operations described below, and employing the logic set forth in the FIG. 7 flow chart.

Device 120 further includes an input/output module 124, which receives control signals from the programmable controller 122. In response to control signals from the programmable controller, the input/output module provides electric currents to energize solenoids for opening and closing various air valves connected to the pneumatic cylinders described above. The input/output module also provides electric currents via speed control potentiometers 126 to the above stepper motor, to control the vertical position and speed of the head assembly, and for storing the number of counts supplied to the stepper motor, to achieve precisely controlled vertical positions during head assembly operations. The input/output device is constructed conventionally to carry out the machine/activation operations described herein.

Figure 7:
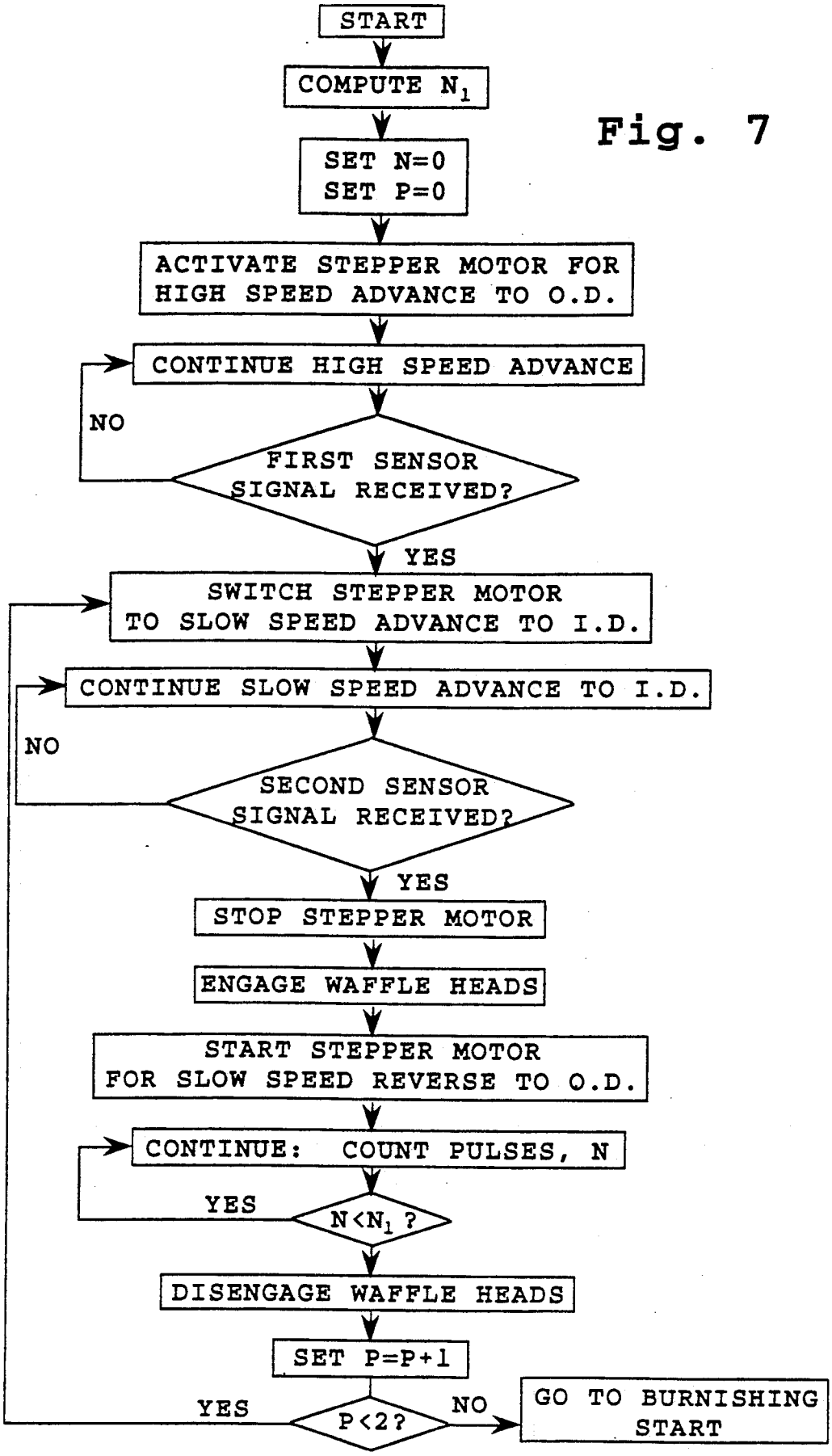
FIG. 7 is a flow chart showing the programmable operations carried out by the logic device in executing a waffling step.

The steps by which the upward movement of the head assembly is controlled are shown in the flow diagram in FIG. 7. As seen, the worm drive is advanced upwardly at a relatively fast speed, by supplying pulses from the input/ output device to the stepper motor at a preselected, relatively rapid pulse rate, until the upper element triggers the sensor, indicating that the head assembly is close to its uppermost inner-diameter position. When this position is sensed, the rate of pulses supplied to the sensor motor is decreased, to slow the head assembly as it approaches its inner-diameter position. Pulses to the stepper motor are terminated when the second element position triggers the sensor that the inner-diameter position has been reached. Other operations of the head assembly shown in the figure will be considered below.

The operation of apparatus 10 in carrying out disc surface-treatment method of the invention, will now be considered. The logic device is first instructed as to disc size, e.g., 95 or 130 mm, which will determine the inner-diameter and outer-diameter positions of the head assembly. The device is then instructed as to disc speed at each stage of the operation, the desired tape-burnishing and waffle-burnishing times, the number of tape-burnishing steps, the sequence of burnishing steps, and the fluid, if any, which is to be applied to the upper or lower pairs of tape subassemblies, during one or more tape-burnishing steps.

The logic device is programmed to execute the following sequence of operations:

(1) activate the drive mechanism to rotate the disc to a suitable burnishing speed, e.g., 100 rpm;

(2) activate the tape assembly to move from its retracted to its operative position;

(3) activate the subassembly arms, to place the four tape rollers in contact with the spinning disc, at a selected pressure, with the disc spinning and the tape in each subassembly being advanced at a selected rate;

(4) after a selected tape-burnishing period, activate the tape rollers to move to their open positions and activate the assembly to move to its retracted position;

(5) activate the worm drive to raise the head assembly from its retracted to its inner-diameter position, in the two-speed operation described above and shown in FIG. 7;

(6) with the disc either stopped or spinning at a selected speed, activate cylinder 76 to place the heads in contact with the disc;

(7) if the disc is not already spinning, activate the drive mechanism to a speed, e.g., 600 rpm, at which the heads will fly over the disc;

(8) activate the stepper motor to move the head assembly from its inner-diameter to outer-diameter position; at a relatively slow speed, with the heads flying over opposite disc surfaces, where the movement of the head assembly between its inner-diameter and outer-diameter positions is controlled by the number of pulses (stored in memory) supplied to the stepper motor;

(9) activate cylinder 76 to place the heads in an open position, and repeat operations (5)–(8) to treat the disc to a second waffling operation;

(10) activate cylinder 76 to place the heads in an open position, and activate the worm drive to move the head assembly to its retracted position;

(11) repeat operations (1)–(4) to subject the disc to a second tape-burnishing operation.

More generally, the method of the invention, as carried out by apparatus 10, includes the steps of:

(a) rotating the disc about a fixed horizontal axis, as in operation (1)

(b) contacting the opposite-side surfaces of the disc with a pair of movable, belt-like tapes to remove loosely bound debris from the disc surface, with the disc rotating at one speed, as in operations (2)–(4), (c) contacting the opposite-side surfaces of the disc with a pair of flying heads to dislodge asperities on the disc surface, with the disc rotating at a higher selected speed about the same axis, as in operations (5)–(10), and (d) contacting the disc a second time with the belt-like tapes to remove loosely bound particles dislodged from the disc by the flying heads, as in operation (11).

In one preferred embodiment of the method, in which the apparatus has non-abrasive cloth tapes in its lower tape subassemblies, and abrasive tapes in its upper tape subassemblies, the first and/or second tape-burnishing steps further include applying a cleaner and/or lubricant to the disc, by applying the cleaner or lubricant to the segments of the upper tapes. Thus, for example, a lubricant may be applied to the disc in the first tape-burnishing step, by infusing lubricant into the upper tape segments which contact the disc. Tape burnishing is carried out by the abrasive tape in the lower tape assemblies The lubricant is preferably applied to the disc at a disc speed of about 1800 rpm, whereas the tape-burnishing procedure is preferably carried at a lower speed, e.g., about 100 rpm. Following the waffle-burnishing steps, the final tape treatment step may involve contact with the upper cloth tapes only, to remove particles left from the waffle-burnishing step, or the abrasive tapes only, to give the discs a second tape burnishing, or a combination of both tapes, to burnish and "wipe" the disc surfaces.

Applying the lubricant in the first tape-burnishing step has the advantage of improving the burnishing characteristics achieved by the tape and/or waffle-burnishing steps. A second lubricant application step, in the second tape-burnishing step, may insure a more even lubricant coat on the disc after waffle burnishing.

From the foregoing, it can be appreciated how various objects and features of the invention are met. The apparatus and method reduce the time and effort required for surface treating a thin-film magnetic disc, since the tape- and waffle-burnishing steps are done in a single machine, in an automated fashion. The second tape-burnishing step in the method further removes loosely bound particles which may be present on the disc surfaces as a result of the waffling treatment. Finally, where the tapes in the tape assembly are used to lubricate the disc, the lubricant is applied both before and after waffling, to improve waffl-burnishing treatment and to ensure an even lubricant coat as a final treatment step.

Although the invention has been described with reference to particular embodiments, it will be apparent that various changes and modifications may be made without departing from the invention.

It is claimed:

1. Apparatus for automated surface treatment of a magnetic disc having known inner and outer diameter dimensions, comprising a frame;

a drive mechanism attached to the frame adapted for rotating the disc about a fixed, horizontal axis at a selected disc rotation speed, a tape assembly having movable, belt-like tapes adapted to contact opposite-side surfaces of the disc, at a selected tape speed, with the disc carried on the drive mechanism, when the tape assembly is moved to an operative position and activated to place the tapes in contact with the opposite-side surfaces of the disc, a head assembly having a pair of heads adapted to fly over the opposite-side surfaces of the disc, with such spinning on the drive mechanism, as the heads are moved from an inner-diameter position to an outer-diameter position adjacent the disc, and activated to position the heads for flying over the spinning disc, means for moving the tape assembly between its operative position and a retracted position at which the head assembly can be positioned at its inner-diameter position, and for activating the tapes for contacting the surfaces of a disc, when the tape assembly is in its operative position, means for moving the head assembly from its inner-diameter position to its outer-diameter position, and for activating the heads, to position the heads for flying over the disc as the heads are moved from inner- to outer-diameter positions, and for moving the head assembly from its outer-diameter position to a retracted position at which the tape assembly can be moved to its operative position, said means including a worm screw, and a stepper motor which drives the worm screw, and programmable means for controlling in a selected sequence the rotation of the disc, the movement and activation of the tape assembly, and the movement and activation of the head assembly, including means for delivering pulses to the stepper motor, at a relatively high rate, when the tape assembly is moved from its retracted position to a position close to its inner-diameter position, and for delivering pulses to the stepper motor at a relatively slow rate when the tape assembly is moved from such close position to the inner-diameter position, and from its inner-diameter to its outer-diameter position.

2. Apparatus for automated surface treatment of a magnetic disc having known inner and outer diameter dimensions, comprising a frame;

a drive mechanism attached to the frame adapted for rotating the disc about a fixed, horizontal axis at a selected disc rotation speed, a tape assembly having movable, belt-like tapes adapted to contact opposite-side surfaces of the disc, at a selected tape speed, with the disc carried on the drive mechanism, when the tape assembly is moved to an operative position and activated to place the tapes in contact with the opposite-side surfaces of the disc, wherein the tape assembly includes a pair of upper tapes for contacting upper opposite-side surface regions of the disc, and a pair of lower discs for contacting lower opposite-side surface regions of the disc, and one of the pairs of tapes contains a lubricant for applying a lubricant to opposite-side surfaces of the disc, and the other pair of tapes contains a particle abrasive for abrading the disc surfaces, a head assembly having a pair of heads adapted to fly over the opposite-side surfaces of the disc, with such spinning on the drive mechanism, as the heads are moved from an inner-diameter position to an outer-diameter position adjacent the disc, and activated to position the heads for flying over the spinning disc, means for moving the tape assembly between its operative position and a retracted position at which the head assembly can be positioned at its inner-diameter position, and for activating the tapes for contacting the surfaces of a disc, when the tape assembly is in its operative position, means for moving the head assembly from its inner-diameter position to its outer-diameter position, and for activating the heads, to position the heads for flying over the disc as the heads are moved from inner- to outer-diameter positions, and for moving the head assembly from its outer-diameter position to a retracted position at which the tape assembly can be moved to its operative position, and programmable means for controlling in a selected sequence the rotation of the disc, the movement and activation of the tape assembly, and the movement and activation of the head assembly.

3. Apparatus for automated surface treatment of a magnetic disc having known inner and outer diameter dimensions, comprising a frame;

a drive mechanism attached to the frame adapted for rotating the disc about a fixed, horizontal axis at a selected disc rotation speed, a tape assembly having movable, belt-like tapes adapted to contact opposite-side surfaces of the disc, at a selected tape speed, with the disc carried on the drive mechanism, when the tape assembly is moved to an operative position and activated to place the tapes in contact with the opposite-side surfaces of the disc, a head assembly having a pair of heads adapted to fly over the opposite-side surfaces of the disc, with such spinning on the drive mechanism, as the heads are moved from an inner-diameter position to an outer-diameter position adjacent the disc, and activated to position the heads for flying over the spinning disc, means for moving the tape assembly between its operative position and a retracted position at which the head assembly can be positioned at its inner-diameter position, and for activating the tapes for contacting the surfaces of a disc, when the tape assembly is in its operative position, means for moving the head assembly from its inner-diameter position to its outer-diameter position, and for activating the heads, to position the heads for flying over the disc as the heads are moved from inner- to outer-diameter positions, and for moving the head assembly from its outer-diameter position to a retracted position at which the tape assembly can be moved to its operative position, and programmable means for controlling in a selected sequence the rotation of the disc, the movement and activation of the tape assembly, and the movement and activation of the head assembly, being operative to:

(a) move the tape assembly from its retracted to its operative position, and activate the assembly for contacting the disc, at one selected disc speed, (b) after a selected period of contact of the tape assembly and the disc, move the tape assembly to its retracted position, (c) move the head assembly to its inner-diameter position, (d) activate the head assembly to place the heads in a position for flying over the spinning disc, (e) with the disc spinning at a second selected speed, and the heads activated for flying ove the disc, move the head assembly from its inner-diameter to its outer diameter position, (f) repeat steps (c) to (e), (g) move the head assembly from its outer-diameter position to its retracted position, and (h) repeat steps (a) and (b).

* * * * *